US011236405B2

(12) United States Patent
Kimura et al.

(10) Patent No.: US 11,236,405 B2
(45) Date of Patent: Feb. 1, 2022

(54) STEEL PLATE FOR HIGH-STRENGTH AND HIGH-TOUGHNESS STEEL PIPES AND METHOD FOR PRODUCING STEEL PLATE

(71) Applicant: JFE Steel Corporation, Tokyo (JP)

(72) Inventors: Hideyuki Kimura, Tokyo (JP); Ryo Nagao, Tokyo (JP); Nobuyuki Ishikawa, Tokyo (JP); Kazukuni Hase, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 230 days.

(21) Appl. No.: 16/072,717

(22) PCT Filed: Jan. 23, 2017

(86) PCT No.: PCT/JP2017/002060
§ 371 (c)(1),
(2) Date: Jul. 25, 2018

(87) PCT Pub. No.: WO2017/130885
PCT Pub. Date: Aug. 3, 2017

(65) Prior Publication Data

US 2019/0040488 A1 Feb. 7, 2019

(30) Foreign Application Priority Data

Jan. 29, 2016 (JP) ..... JP2016-015000

(51) Int. Cl.
*C21D 9/46* (2006.01)
*C21D 8/02* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 9/46; C21D 6/00; C22C 38/00
See application file for complete search history.

(56) References Cited

U.S. PATENT DOCUMENTS 5,755,895 A * 5/1998 Tamehiro ..... C22C 38/04 148/336
2013/0092295 A1 4/2013 Yokoi et al.

FOREIGN PATENT DOCUMENTS

CN 101781737 A 7/2010
EP 0757113 A1 2/1997
(Continued)

OTHER PUBLICATIONS

Korean Office Action for Korean Application No. 10-2018-7021674, dated Mar. 10, 2020, with Concise Statement of Relevance of Office Action, 4 pages.
(Continued)

*Primary Examiner* — Nicholas A Wang
*Assistant Examiner* — Jiangtian Xu
(74) *Attorney, Agent, or Firm* — RatnerPrestia

(57) ABSTRACT

A steel plate for high-strength and high-toughness steel pipes has a chemical composition containing, by mass %, C: 0.03% or more and 0.08% or less, Si: more than 0.05% and 0.50% or less, Mn: 1.5% or more and 2.5% or less, P: 0.001% or more and 0.010% or less, S: 0.0030% or less, Al: 0.01% or more and 0.08% or less, Nb: 0.010% or more and 0.080% or less, Ti: 0.005% or more and 0.025% or less, and N: 0.001% or more and 0.006% or less, and further containing, by mass %, at least one selected from Cu: 0.01% or more and 1.00% or less, Ni: 0.01% or more and 1.00% or less, Cr: 0.01% or more and 1.00% or less, Mo: 0.01% or more and 1.00% or less, V: 0.01% or more and 0.10% or less, and B: 0.0005% or more and 0.0030% or less, with the balance being Fe and inevitable impurities. The steel plate has a microstructure in which an area fraction of ferrite at a
(Continued)

* NON-EVALUATION REGION
t mm WHEN THICKNESS t < 19 mm
19 mm WHEN THICKNESS t ≥ 19 mm

½ position of a thickness of the steel plate is 20% or more and 80% or less and deformed ferrite constitutes 50% or more and 100% or less of the ferrite.

16 Claims, 1 Drawing Sheet

(51) Int. Cl.

| | |
|---|---|
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |
| ***C22C 38/58*** | (2006.01) |
| ***C22C 38/46*** | (2006.01) |
| ***C22C 38/32*** | (2006.01) |
| ***C22C 38/44*** | (2006.01) |
| ***C22C 38/50*** | (2006.01) |
| ***C22C 38/48*** | (2006.01) |
| ***C22C 38/42*** | (2006.01) |
| ***C21D 6/00*** | (2006.01) |
| ***C21D 9/08*** | (2006.01) |

(52) U.S. Cl.

CPC ..... *C21D 8/0205* (2013.01); *C21D 8/0226* (2013.01); *C21D 8/105* (2013.01); *C21D 9/08* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/26* (2013.01); *C22C 38/28* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/002* (2013.01); *C21D 2211/005* (2013.01); *C21D 2211/008* (2013.01); *C21D 2211/009* (2013.01)

(56) References Cited

FOREIGN PATENT DOCUMENTS

| | | | |
|---|---|---|---|
| EP | 1354973 | A1 | 10/2003 |
| EP | 1860204 | A1 | 11/2007 |
| JP | 5741323 | A | 3/1982 |
| JP | 01176026 | A | 7/1989 |
| JP | 0941074 | A | 2/1997 |
| JP | H10147845 | A | 6/1998 |
| JP | 2009127069 | A | 6/2009 |
| JP | 2009161824 | A | 7/2009 |
| JP | 2012072472 | A | 4/2012 |
| KR | 100222302 | B1 | 10/1999 |
| WO | 2011042936 | A1 | 4/2011 |
| WO | 2012002481 | A1 | 1/2012 |

OTHER PUBLICATIONS

International Search Report and Written Opinion for International Application No. PCT/JP2017/002060, dated Mar. 21, 2017—5 pages.

Hirosuke Inagaki, "Condition of the Formation of Separations in Control-Rolled Steels: Separation in Control-Rolled Steel IV", Journal of the Iron & Steel Institute of Japan, 1984, vol. 70, No. 13, p. S1398, Fig. 1, lower part.

Chinese Office Action with Search Report for Chinese Application No. 201780008699.8, dated Aug. 15, 2019, 13 pages.

Korean Office Action for Korean Application No. 10-2018-7021674 dated Aug. 26, 2019, with Concise Statement of Relevance of Office Action, 5 pages.

Extended European Search Report for European Application No. 17 744 115.1, dated Nov. 14, 2018, 11 pages.

* cited by examiner

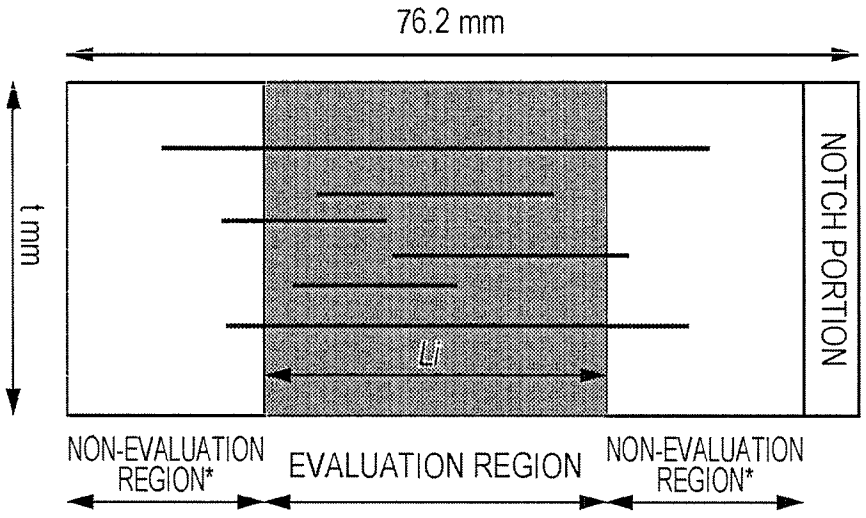
* NON-EVALUATION REGION
t mm WHEN THICKNESS t < 19 mm
19 mm WHEN THICKNESS t ≥ 19 mm

STEEL PLATE FOR HIGH-STRENGTH AND HIGH-TOUGHNESS STEEL PIPES AND METHOD FOR PRODUCING STEEL PLATE

CROSS REFERENCE TO RELATED APPLICATIONS

This is the U.S. National Phase application of PCT/JP2017/002060, filed Jan. 23, 2017, which claims priority to Japanese Patent Application No. 2016-015000, filed Jan. 29, 2016, the disclosures of each of these applications being incorporated herein by reference in their entireties for all purposes.

FIELD OF THE INVENTION

The present invention relates to steel plates for high-strength and high-toughness steel pipes and methods for producing such steel plates. In particular, the present invention relates to a high-strength and high-toughness steel plate suitable as a material of steel pipes that can serve as line pipes having excellent brittle crack arrestability, and to a method for producing the steel plate.

BACKGROUND OF THE INVENTION

Line pipes are used to transport natural gas or crude oil, for example. In attempts to improve transport efficiency by higher-pressure operation and to improve on-site welding efficiency by thinning pipe walls, there is an ever increasing need for higher strength.

In particular, in line pipes for transporting high-pressure gas (hereinafter also referred to as high-pressure gas line pipes), it is very important to inhibit brittle fracture in order to avoid catastrophic fracture. A DWTT (Drop Weight Tear Test) test value (fracture appearance transition temperature at which a percent ductile fracture of 85% is reached) necessary for inhibiting brittle fracture is specified, and thus an excellent DWTT property is required. The DWTT value is determined from results of past gas burst tests of full-scale pipes.

Furthermore, in recent years, there has been a trend toward increasing development of gas fields and oil fields in arctic regions such as Russia and Alaska and in cold regions such as the North Sea. The base steel of line pipes to be laid in an arctic region or a cold region is required to have excellent brittle crack arrestability, and further the base steel is required to have excellent low-temperature toughness.

To address such requirements, Patent Literature 1 discloses the following technique. In the chemical composition, the equivalent carbon content (Ceq) is controlled to be from 0.30 to 0.45. Hot rolling is performed in a non-recrystallization temperature range, at an accumulated rolling reduction ratio of 50% or more, and in the two-phase region, at an accumulated rolling reduction ratio of 10 to 50%. Thereafter, reheating to 450 to 700° C. is immediately performed. Based on the technique, Patent Literature 1 discloses a steel plate for high-toughness line pipes and a method for producing the steel plate. The steel plate has a tensile strength of 565 MPa or more. The base steel has excellent toughness. The heat affected zone (HAZ: Heat Affected Zone) has a microstructure in which the area fraction of the upper bainite is 90% or more provided that the steel plate is subjected to welding with a welding heat input of 4 to 10 kJ/mm. In the upper bainite, the area fraction of the martensite-austenite constituent is controlled to be 3% or less. Thus, the HAZ toughness is improved.

Patent Literature 2 discloses the following method for producing a high-yield strength and high-toughness steel plate having excellent brittle crack arrestability and excellent weld heat affected zone toughness. In the chemical composition, the Si content is reduced to a level of substantially zero and the equivalent carbon content (Ceq) is controlled to be 0.30 to 0.45. Hot rolling is performed at 900° C. or lower, in a non-recrystallization temperature range, at an accumulated rolling reduction ratio of 50% or more, and in a two-phase region, at an accumulated rolling reduction ratio of 10 to 50%. Thereafter, cooling is performed at a cooling rate of 10 to 80° C./s to a cooling stop temperature of 400° C. or lower. Thereafter, immediately, reheating to a temperature higher than the cooling stop temperature and in the range of 150° C. or higher and lower than 450° C. is performed.

Patent Literature 3 discloses an ultra-high-tensile steel plate having excellent low-temperature toughness. The steel plate contains, by mass %, C: 0.05 to 0.10%, Mn: 1.8 to 2.5%, Mo: 0.30 to 0.60%, Nb: 0.01 to 0.10%, V: 0.03 to 0.10%, and Ti: 0.005 to 0.030%, with a P value (=2.7C+0.4Si+Mn+Mo+V) of 1.9 to 2.8. The microstructure is a two-phase structure formed of martensite-bainite and 20 to 90% ferrite. The ferrite includes 50 to 100% deformed ferrite and the ferrite has an average grain diameter of 5 μm or less.

Patent Literature 4 discloses a steel plate for high-toughness and high-deformability high-strength steel pipes and a method for producing the steel plate. The steel plate contains, by mass %, C: 0.04 to 0.08%, Si: 0.05 to 0.5%, Mn: 1.8 to 3.0%, P: 0.08% or less, S: 0.0006% or less, Ni: 0.1 to 1.0%, Cr: 0.01 to 0.5%, Nb: 0.01 to 0.05%, and Ti: 0.005 to 0.020%. In the microstructure, the area fraction of bainite is 85% or more, the martensite-austenite constituent in the bainite is uniformly dispersed and constitutes an area fraction of 5 to 15%, and the area fraction of ferrite existing at prior austenite grain boundaries is 5% or less. The separation index (SI) in the fractured surface is 0.05 $mm^{-1}$ or less provided that a Charpy impact test is conducted at a test temperature of −30° C. The separation index (SI) is defined as a "value obtained by dividing the total sum of the lengths of separations having a length of 1 mm or more in the fractured surface by the area of the surface for evaluation on the fractured surface".

PATENT LITERATURE

PTL 1: Japanese Unexamined Patent Application Publication No. 2009-127069

PTL 2: Japanese Unexamined Patent Application Publication No. 2009-161824

PTL 3: Japanese Unexamined Patent Application Publication No. 9-41074

PTL 4: Japanese Unexamined Patent Application Publication No. 2012-72472

SUMMARY OF THE INVENTION

Steel plates used for, for example, recent high-pressure gas line pipes are required to have higher strength and higher toughness. Specifically, it is required that, after forming a steel pipe from a steel plate, the base steel of the steel pipe has a tensile strength of 625 MPa or more and that the base steel of the steel pipe has a percent ductile fracture of 85% or more, as determined by a DWTT test at −45° C.

In Patent Literature 1, the DWTT property, which is an evaluation index associated with inhibiting brittle fracture, is evaluated as follows. The test piece is taken from a t/2 (hereinafter, "t" represents thickness) position of the steel plate, which has a thickness of 33 mm, and the test piece has a reduced thickness of 19 mm. A percent ductile fracture at a test temperature of −47° C. is used. The percent ductile fracture tends to increase when the thickness of the test piece is reduced. In addition, line pipes that are to be laid may have degraded properties resulting from deformation during pipe forming. In view of the above, there is room for improvement in the invention disclosed in Patent Literature 1.

In Patent Literature 2, a reheating process needs to be performed immediately after rolling and rapid cooling, and thus an on-line heating device is necessary. This can result in increased production costs due to additional production processes. In addition, the DWTT property is evaluated as follows. The test piece is taken from a t/2 position of the steel plate, which has a thickness of 33 mm, and the test piece has a reduced thickness of 19 mm. A percent ductile fracture at a test temperature of −47° C. is used. The percent ductile fracture tends to increase when the thickness of the test piece is reduced. In addition, line pipes that are to be laid may have degraded properties resulting from deformation during pipe forming. In view of the above, there is room for improvement in the invention disclosed in Patent Literature 2.

Patent Literature 3 discloses a technique related to an ultra-high-strength steel plate having excellent low-temperature toughness. The steel plate has a tensile strength of TS≥950 MPa and has a microstructure including 20 to 90% ferrite. The ferrite includes 50 to 100% deformed ferrite and has an average grain diameter of 5 μm or less. The low-temperature toughness of the base steel, however, is determined based on a 50% fracture appearance transition temperature (vTrs), as determined by a Charpy test, and no description is given of a full-thickness DWTT test, which has a high correlation with gas burst tests of full-scale pipes. Thus, the invention disclosed in Patent Literature 3 may have low brittle fracture arrestability, for the full-thickness, which includes the surface portion, where the cooling rate is high and thus the fraction of the hard phase tends to increase.

Patent Literature 4 is directed toward achieving both high absorbed energy and low-temperature toughness by appropriately controlling the amount of occurrence of separations. By inhibiting separations, the Charpy impact absorbed energy is improved. However, in the DWTT test in Examples, evaluations are made by using a percent ductile fracture at −20° C. Thus, there is room for improvement for lower-temperature use environments, at, for example, −45° C.

The techniques disclosed in Patent Literature 1 to 4 do not achieve stable production of a steel plate that can be used as a material of high-strength and high-toughness steel pipes that can be used for more severe laying and use environments.

Accordingly, in view of such circumstances, an object of the present invention is to provide a steel plate that can be used as a material of steel pipes that have a tensile strength of 625 MPa or more and a percent ductile fracture of 85% or more, as determined by a DWTT test at −45° C. Also, a method for producing such a steel plate is provided. Here, it can be assumed that, during pipe forming, the DWTT property decreases by an amount corresponding to a test temperature difference of 10° C. In this regard, an object of the present invention is to provide a steel plate for high-strength and high-toughness steel pipes, in which the steel plate has a tensile strength of 625 MPa or more and a percent ductile fracture ($SA_{-55° C.}$) of 85% or more, as determined by a DWTT test at −55° C.

For the steel plate for high-strength and high-toughness steel pipes of the present invention, the term "high-strength" refers to a tensile strength (TS) in a C direction of 625 MPa or more, as determined by a tensile test, which is described in the later-discussed Example (the C direction is a direction perpendicular to the rolling direction). The term "high-toughness" refers to a percent ductile fracture ($SA_{-55° C.}$) of 85% or more, as determined by a DWTT test, which is described in the later-discussed Example.

The present inventors quantitatively determined the amount of occurrence of separations in order to achieve target brittle crack arrestability, while referring to the percent ductile fracture (SA-5), which is an evaluation index. The schematic diagram of the FIGURE is a diagram for describing a method for measuring the separation index ($SI_{-55° C.}$). For separations that occur in the fractured surface of a DWTT test piece when a DWTT test is conducted, SI is calculated as follows. Separations that occur in the fractured surface of the test piece are visually observed within an evaluation region. The lengths of all the separations having a length of 1 mm or more are measured and the total sum of the lengths is divided by the area of the evaluation region. The evaluation region is a region excluding a first portion and a second portion in the test piece. The first portion has a dimension extending from the press notch side to the evaluation region and the second portion has a dimension extending from the drop weight impact side to the evaluation region. The dimension of the first portion and the dimension of the second portion are each equal to the thickness, t, of the test piece (in the case that the thickness t<19 mm) or are each 19 mm (in the case that the thickness t≥19 mm). For various types of steel plates for materials of steel pipes having a tensile strength of 625 MPa or more, the relationship between the separation index ($SI_{-55° C.}$) and the percent ductile fracture ($SA_{-55° C.}$) of the DWTT test was analyzed, and it was found that, to achieve target brittle crack arrestability, as evaluated by $SA_{-55° C.}$, it is necessary to satisfy $SI_{-55° C.} \geq 0.10\ mm^{-1}$. That is, at least in the case that the $SI_{-55° C.}$ value is outside the range, it is impossible to achieve a target $SA_{-55° C.}$ value.

Furthermore, the present inventors conducted intensive studies of steel plates for steel pipes, regarding various factors that affect the DWTT property. Consequently, the present inventors found that a steel plate for high-strength and high-toughness steel pipes having an excellent DWTT property and which can be used for more severe, low-temperature use environments can be produced as follows. A steel plate containing, for example, C, Mn, Nb, and Ti may be used. The accumulated rolling reduction ratio in the two-phase region may be controlled to produce separations, which results in an effect of improving low-temperature toughness. Also, the accumulated rolling reduction ratio in the austenite non-crystallization temperature range, on a low-temperature side, may be controlled to refine the microstructure, which results in an effect of improving low-temperature toughness. These effects may be utilized.

The present inventors conducted further studies based on the above findings and made the present invention. The present invention according to exemplary embodiments is summarized as described below.

[1] A steel plate for high-strength and high-toughness steel pipes, is provided. The steel plate has a chemical composition containing, by mass %, C: 0.03% or more and 0.08% or less, Si: more than 0.05% and 0.50% or less, Mn: 1.5% or more and 2.5% or less, P: 0.001% or more and 0.010% or less, S: 0.0030% or less, Al: 0.01% or more and 0.08% or less, Nb: 0.010% or more and 0.080% or less, Ti: 0.005% or more and 0.025% or less, and N: 0.001% or more and 0.006% or less, and further containing, by mass %, at least one selected from Cu: 0.01% or more and 1.00% or less, Ni: 0.01% or more and 1.00% or less, Cr: 0.01% or more and 1.00% or less, Mo: 0.01% or more and 1.00% or less, V: 0.01% or more and 0.10% or less, and B: 0.0005% or more and 0.0030% or less, with the balance being Fe and inevitable impurities. The steel plate has a microstructure in which an area fraction of ferrite at a ½ position of a thickness of the steel plate is 20% or more and 80% or less and deformed ferrite constitutes 50% or more and 100% or less of the ferrite. Separations that occur in a fractured surface of a test piece of the steel plate have a separation index ($SI_{-55°\ C.}$) of 0.10 $mm^{-1}$ or more provided that the test piece is subjected to a DWTT test (Drop Weight Tear Test) at a test temperature of −55° C., the separation index being defined by formula (1).

$$SI_{-55°\ C.}(mm^{-1})=\Sigma Li/A \quad (1)$$

ΣLi: a total of lengths (mm) of separations having a length of 1 mm or more existing in an evaluation region (A) of the test piece for the DWTT test A: an area ($mm^2$) of the evaluation region of the test piece for the DWTT test, the evaluation region being a region excluding a first portion and a second portion in the test piece, the first portion having a dimension extending from a press notch side to the evaluation region, the second portion having a dimension extending from a drop weight impact side to the evaluation region, the dimension of the first portion and the dimension of the second portion each being equal to a thickness, t, of the test piece (in a case that the thickness t<19 mm) or each being 19 mm (in a case that the thickness t≥19 mm)

[2] In the steel plate according to [1] for high-strength and high-toughness steel pipes, the chemical composition further contains, by mass %, at least one selected from Ca: 0.0005% or more and 0.0100% or less, REM: 0.0005% or more and 0.0200% or less, Zr: 0.0005% or more and 0.0300% or less, and Mg: 0.0005% or more and 0.0100% or less.

[3] A method for producing a steel plate for high-strength and high-toughness steel pipes is provided. The method is formulated to produce the steel plate according to [1] or [2] for high-strength and high-toughness steel pipes. The method includes hot rolling and cooling. The hot rolling is carried out by heating a steel slab to a range of 1000° C. or higher and 1250° C. or lower, rolling the steel slab in an austenite recrystallization temperature range, thereafter rolling is performed in a range of an $Ar_3$ temperature or higher and ($Ar_3$ temperature+150° C.) or lower, at an accumulated rolling reduction ratio of 50% or more, and thereafter rolling is performed in a range of (the $Ar_3$ temperature−50° C.) or higher and lower than the $Ar_3$ temperature, at an accumulated rolling reduction ratio of more than 50%. The cooling is carried out, immediately after the hot rolling, by cooling the steel plate by accelerated cooling at a cooling rate of 10° C./s or higher and 80° C./s or lower to a cooling stop temperature of 250° C. or higher and 450° C. or lower, and thereafter naturally cooling the steel plate to a temperature range of 100° C. or lower.

In the production method according to embodiments of the present invention, the rolling conditions and the post-rolling cooling conditions are appropriately controlled. As a result, in the obtained microstructure, the area fraction of ferrite at a ½ position of the plate thickness is 20% or more and 80% or less and deformed ferrite constitutes 50% or more and 100% or less of the ferrite. The produced steel plates achieve high strength and high toughness.

Steel plates according to embodiments of the present invention are steel plates for high-strength and high-toughness steel pipes. The steel plates, utilizing separations, have a tensile strength (C direction) of 625 MPa or more and a percent ductile fracture ($SA_{-55°\ C.}$) of 85% or more, as determined by a DWTT test at −55° C. Steel plates according to embodiments of the present invention are expected to be used for line pipes. It is predicted that installation of line pipes will increase in cold regions and/or arctic regions where, in winter, the ambient temperature decreases to lower than or equal to −40° C. Examples of the line pipes include high-pressure gas line pipes for a pressure of, for example, not less than 10 MPa.

BRIEF DESCRIPTION OF DRAWINGS

The FIGURE is a schematic diagram for describing a method for measuring the separation index ($SI_{-55°\ C.}$).

DETAILED DESCRIPTION OF EMBODIMENTS OF THE INVENTION

The present invention will now be described in detail.

According to an embodiment of the present invention, a steel plate for high-strength and high-toughness steel pipes has a chemical composition containing, by mass %, C: 0.03% or more and 0.08% or less, Si: more than 0.05% and 0.50% or less, Mn: 1.5% or more and 2.5% or less, P: 0.001% or more and 0.010% or less, S: 0.0030% or less, Al: 0.01% or more and 0.08% or less, Nb: 0.010% or more and 0.080% or less, Ti: 0.005% or more and 0.025% or less, and N: 0.001% or more and 0.006% or less, and further containing, by mass %, at least one selected from Cu: 0.01% or more and 1.00% or less, Ni: 0.01% or more and 1.00% or less, Cr: 0.01% or more and 1.00% or less, Mo: 0.01% or more and 1.00% or less, V: 0.01% or more and 0.10% or less, and B: 0.0005% or more and 0.0030% or less, with the balance being Fe and inevitable impurities, wherein the steel plate has a microstructure in which an area fraction of ferrite at a ½ position of a thickness of the steel plate is 20% or more and 80% or less and deformed ferrite constitutes 50% or more and 100% or less of the ferrite.

First, reasons for the limitations on the chemical composition of the present invention will be described. It is to be noted that percentages regarding the chemical composition are percentages on a mass basis.

C: 0.03% or more and 0.08% or less

C effectively acts to increase strength through transformation strengthening. However, if the C content is less than 0.03%, a desired tensile strength (TS 625 MPa) may not be achieved. Also, during cooling, ferrite transformation and pearlite transformation tend to occur, and as a result, the amount of bainite tends to decrease. On the other hand, if the C content is more than 0.08%, hard martensite tends to form after accelerated cooling. As a result, the base steel may have a low Charpy impact absorbed energy and a low DWTT property ($SA_{-55°\ C.}$). Also, the hardness of the surface-layer portion may increase after accelerated cooling, which may result in wrinkles or surface defects during steel pipe forming. Thus, the C content is 0.03% or more and 0.08% or less, and preferably 0.03% or more and 0.07% or less.

Si: more than 0.05% and 0.50% or less

Si is an element necessary for deoxidization and further has the effect of improving the strength of steel through solid-solution strengthening. To produce this effect, Si needs to be included in an amount of more than 0.05%. The Si content is preferably not less than 0.10%, and more preferably not less than 0.15%. On the other hand, if the Si content is more than 0.50%, the weldability and the Charpy impact absorbed energy of the base steel decrease. Thus, the Si content is not more than 0.50%. To prevent degradation of the toughness of the HAZ, it is preferable that the Si content not be more than 0.20%.

Mn: 1.5% or more and 2.5% or less

Mn, similarly to C, forms bainite after accelerated cooling and effectively acts to increase strength through transformation strengthening. However, if the Mn content is less than 1.5%, a desired tensile strength (TS 625 MPa) may not be achieved. Also, during cooling, ferrite transformation and pearlite transformation tend to occur, and as a result, the amount of bainite tends to decrease. On the other hand, if Mn is included in an amount of more than 2.5%, Mn becomes concentrated in a segregated portion, which inevitably forms during casting. The portion may cause a low Charpy impact absorbed energy or a low DWTT property ($SA_{-55° C.}$). Thus, the Mn content is 1.5% or more and 2.5% or less. To improve toughness, it is preferable that the Mn content be 1.5% or more and 2.0% or less.

P: 0.001% or more and 0.010% or less

P is an element effective for increasing the strength of the steel plate through solid-solution strengthening. However, if the P content is less than 0.001%, the effect may not be produced, and also, the cost of dephosphorization in the steel-making process may increase. Thus, the P content is not less than 0.001%. On the other hand, if the P content is more than 0.010%, the toughness and weldability may be markedly low. Thus, the P content is 0.001% or more and 0.010% or less.

S: 0.0030% or less

S is a harmful element that causes hot shortness and reduces toughness and ductility by forming sulfide-based inclusions in the steel. Thus, the S content is preferably as low as possible. In an embodiment of the present invention, the upper limit of the S content is 0.0030%, and preferably not more than 0.0015%. Although the lower limit is not particularly limited, an extremely low S content results in an increase in the cost of steel-making. Thus, it is preferable that the S content not be less than 0.0001%.

Al: 0.01% or more and 0.08% or less

Al is an element included to serve as a deoxidizer. Also, Al has solid-solution strengthening capability and thus effectively acts to increase the strength of the steel plate. However, if the Al content is less than 0.01%, the effect is not produced. On the other hand, if the Al content is more than 0.08%, the cost of materials increases and the toughness may decrease. Thus, the Al content is 0.01% or more and 0.08% or less, and preferably 0.01% or more and 0.05% or less.

Nb: 0.010% or more and 0.080% or less

Nb is effective for increasing the strength of the steel plate through precipitation strengthening and a hardenability-increasing effect. Also, Nb has the effect of expanding the austenite non-recrystallization temperature range in hot rolling and is thus effective for improving the toughness of the steel plate through a microstructure refining effect by rolling in the non-recrystallization temperature range. To produce these effects, Nb is included in an amount of 0.010% or more. On the other hand, if the Nb content is more than 0.080%, hard martensite tends to form after accelerated cooling. As a result, the base steel may have a low Charpy impact absorbed energy and a low DWTT property ($SA_{-55° C.}$). Also, the toughness of the HAZ is significantly low. Thus, the Nb content is 0.010% or more and 0.080% or less, and preferably 0.010% or more and 0.040% or less.

Ti: 0.005% or more and 0.025% or less

Ti forms nitrides in the steel, and particularly, when included in an amount of 0.005% or more, Ti has the effect of refining austenite grains through a pinning effect of the nitride. Thus, Ti contributes to ensuring sufficient toughness of the base steel and sufficient toughness of the HAZ. In addition, Ti is an element effective for increasing the strength of the steel plate through precipitation strengthening. To produce these effects, Ti is included in an amount of 0.005% or more. It is preferable that the Ti content not be less than 0.008%. On the other hand, if Ti is included in an amount of more than 0.025%, TiN coarsens, which results in a failure to contribute to refining of austenite grains. As a result, the toughness-improving effect is not produced. In addition, coarse TiN can act as an initiation site of ductile cracking or brittle cracking, and as a result, the Charpy impact absorbed energy may significantly decrease and the DWTT property ($SA_{-55° C.}$) may also significantly decrease. Thus, the Ti content is not more than 0.025%, and preferably not more than 0.018%.

N: 0.001% or more and 0.006% or less

N forms a nitride together with Ti to inhibit coarsening of austenite and thus contribute to improving toughness. To produce such a pinning effect, N is included in an amount of 0.001% or more. On the other hand, if the N content is more than 0.006%, degradation of the toughness of the HAZ may be caused by solid solute N. This occurs when TiN is decomposed in the weld zone, particularly in the HAZ, heated to 1450° C. or higher, in the vicinity of the fusion line. Thus, the N content is 0.001% or more and 0.006% or less, and when a high level of toughness is required for the HAZ, it is preferable that the N content be 0.001% or more and 0.004% or less.

In an embodiment of the present invention, in addition to the above-described essential elements, at least one selected from Cu, Ni, Cr, Mo, V, and B is further included.

Cu: 0.01% or more and 1.00% or less, Cr: 0.01% or more and 1.00% or less, Mo: 0.01% or more and 1.00% or less Cu, Cr, and Mo are all elements for improving hardenability and contribute to increasing the strength of the base steel and the HAZ. To produce this effect, one or more of the elements Cu, Cr, and Mo need to be included, each in an amount of 0.01% or more, regardless of which of the elements is included. On the other hand, if the Cu content, the Cr content, or the Mo content is more than 1.00%, the strength-increasing effect becomes saturated. Thus, the contents of Cu, Cr, and Mo, when included, are each 0.01% or more and 1.00% or less.

Ni: 0.01% or more and 1.00% or less

Ni is also an element for improving hardenability and is an useful element because inclusion of Ni does not decrease toughness. To produce this effect, Ni needs to be included in an amount of 0.01% or more. On the other hand, if the Ni content is more than 1.00%, the effect becomes saturated. Furthermore, Ni is very expensive. Thus, the content of Ni, when included, is 0.01% or more and 1.00% or less.

V: 0.01% or more and 0.10% or less

V is an element effective for increasing the strength of the steel plate through precipitation strengthening. To produce this effect, V needs to be included in an amount of 0.01% or more. On the other hand, if the V content is more than 0.10%, an excessive amount of carbide is produced, and this may cause a decrease in toughness. Thus, the content of V, when included, is 0.01% or more and 0.10% or less.

B: 0.0005% or more and 0.0030% or less

B is an element for improving hardenability. B segregates at austenite grain boundaries to suppress ferrite transformation and thus contributes to increasing the strength of the base steel and preventing a reduction in the strength of the HAZ. To produce this effect, B needs to be included in an amount of 0.0005% or more. On the other hand, if the B content is more than 0.0030%, the effect becomes saturated. Thus, the content of B, when included, is 0.0005% or more and 0.0030% or less.

The balance, other than the elements described above, is Fe and inevitable impurities.

As necessary, however, the chemical composition may further include at least one selected from Ca: 0.0005% or more and 0.0100% or less, REM: 0.0005% or more and 0.0200% or less, Zr: 0.0005% or more and 0.0300% or less, and Mg: 0.0005% or more and 0.0100% or less.

Ca, REM, Zr, and Mg each have a function to immobilize S in steel to improve the toughness of the steel plate. This effect is produced by including one or more of these elements, each in an amount of 0.0005% or more, regardless of which of the elements is included. On the other hand, if the Ca content is more than 0.0100%, the REM content is more than 0.0200%, the Zr content is more than 0.0300%, or the Mg content is more than 0.0100%, inclusions in the steel increase, which may decrease toughness. Thus, the contents of these elements, when included, are preferably as follows: Ca: 0.0005% or more and 0.0100% or less, REM: 0.0005% or more and 0.0200% or less, Zr: 0.0005% or more and 0.0300% or less, Mg: 0.0005% or more and 0.0100% or less.

Next, the microstructure will be described.

Steel plates for high-strength and high-toughness steel pipes, according to embodiments of the present invention, have the following base steel properties. The tensile strength (C direction) is 625 MPa or more, the percent ductile fracture ($SA_{-55° C.}$) is 85% or more, as determined by a DWTT test at −55° C., and the separation index ($SI_{-55° C.}$) is 0.10 $mm^{-1}$ or more. To consistently obtain these properties, it is necessary that the area fraction of ferrite be 20% or more and 80% or less in the microstructure, at a ½ position of the plate thickness, and that deformed ferrite constitutes 50% or more and 100% or less of the ferrite. It is preferable that, other than ferrite, including deformed ferrite, a primary constituent of the microstructure be bainite. The other microstructures may include, for example, martensite-austenite constituent, pearlite, and martensite. It is preferable that the total area fraction of the other microstructures be 10% or less.

Area fraction of ferrite at ½ position of plate thickness: 20% or more and 80% or less In an embodiment of the present invention, the area fraction of ferrite is important, and particularly, as will be described later, the amount of deformed ferrite in the ferrite is important. That is, when a steel plate is rolled in the two-phase region, separations occur in the steel plate, in a direction perpendicular to the crack propagation direction in a DWTT test. Separations are fissures due to the texture of deformed ferrite and alleviate stress at the crack tips, which thus improves low-temperature toughness. To produce the effect of separations of improving brittle crack arrestability, the area fraction of ferrite needs to be 20% or more. If the area fraction of ferrite is less than 20%, the DWTT property ($SA_{-55° C.}$) may decrease as a result of a reduced amount of deformed ferrite. In addition, if the area fraction of ferrite is less than 20%, safety against landform deformation, such as ground deformation, may decrease. This is because a reduced amount of deformed ferrite increases the yield ratio (YR), which decreases the deformability of the steel pipe. On the other hand, if the area fraction of ferrite is more than 80%, a desired tensile strength may not be achieved. Also, the area fraction of bainite tends to be small. Thus, the area fraction of ferrite, at a ½ position of the plate thickness, is 20% or more and 80% or less, and preferably, in order to ensure consistent strength and low-temperature toughness, the area fraction of ferrite is 50% or more and 80% or less. It is more preferable that the area fraction of ferrite be 50% or more and 70% or less.

Proportion of deformed ferrite in ferrite: 50% or more and 100% or less

As described above, because of its texture, deformed ferrite causes separations and thus improves low-temperature toughness. If deformed ferrite constitutes less than 50% of the ferrite, a desired amount of separations may not be obtained. As a result, the brittle crack arrestability may be low. Thus, deformed ferrite constitutes 50% or more and 100% or less of the ferrite. To achieve good brittle crack arrestability and an excellent Charpy impact absorbed energy more consistently, it is preferable that deformed ferrite constitutes 80% or more and 100% or less of the ferrite.

Area fraction of bainite at ½ position of plate thickness: 20% or more and 80% or less (preferred condition)

To ensure a desired tensile strength (TS 625 MPa) consistently, it is preferable that the area fraction of bainite be 20% or more. It is more preferable that the area fraction of bainite be 30% or more. If the area fraction of bainite is more than 80%, the DWTT property ($SA_{-55° C.}$) may decrease as a result of a reduced amount of deformed ferrite. In addition, if the area fraction of bainite is more than 80%, safety against landform deformation, such as ground deformation, may decrease. This is because an increase in YR may decrease the deformability of the steel pipe. Thus, it is preferable that the area fraction of bainite not be more than 80%. It is more preferable that the area fraction of bainite not be more than 50%.

Other Constituents of Microstructure at ½ Position of Plate Thickness

The constituents other than ferrite and bainite may include at least one selected from martensite (including martensite-austenite constituent), pearlite, and retained austenite, for example. The total area fraction of the other microstructure may be not more than 10%.

The area fraction of ferrite, described above, may be determined as follows. For example, an L cross section (vertical cross section parallel to the rolling direction) at a ½ position of the plate thickness is mirror polished and then etched in vital. Five fields of view are randomly selected and observed by using an optical microscope at a magnification ranging from 400 to 1000×. Image analysis of photographed images of the microstructure is performed to calculate the area fraction of ferrite. The area fraction is the average of the area fractions of the five fields of view. Deformed ferrite is defined as ferrite having an aspect ratio of 3 or more. The aspect ratio is a ratio of the ferrite grain length in the rolling direction to the ferrite grain length in the thickness direction. Thus, the proportion of deformed ferrite in the total ferrite is calculated.

Further, for example, randomly selected five fields of view may be observed by using a scanning electron microscope (SEM) at a magnification of 2000× to identify the microstructure by photographed images of the microstructure. The area fractions of phases, such as bainite, martensite, martensite-austenite constituent, ferrite (deformed ferrite), and pearlite, for example, may be determined by image analysis. The area fraction is the average of the area fractions of the five fields of view.

In general, the microstructure of a steel plate produced by using accelerated cooling varies in the thickness direction of the steel plate. In an embodiment of the present invention, to achieve target strength and brittle crack arrestability consistently, the limitations are imposed on the microstructure, at a ½ position of the plate thickness (t/2 position of thickness, t), where the cooling rate is low and thus the above-mentioned properties are difficult to achieve.

According to embodiments of the present invention, steel plates for high-strength and high-toughness steel pipes have the following properties.

(1) Tensile strength in the C direction of 625 MPa or more: Line pipes are used to transport natural gas or crude oil, for example. In attempts to improve transport efficiency by higher-pressure operation and to improve on-site welding efficiency by thinning pipe walls, there is an ever increasing need for higher strength. To satisfy the need, the tensile strength in the C direction is 625 MPa or more in an embodiment of the present invention.

Yield ratio (YR) in L direction of 93% or less (preferred condition): In recent years, there has been a trend toward increasing development of gas fields and oil fields in seismic regions and permafrost areas. Accordingly, in some cases, line pipes to be laid are required to have a low yield ratio to ensure safety for cases in which significant landform deformation due to ground deformation occurs. To satisfy the need, in an embodiment of the present invention, the yield ratio is not more than 93%, and preferably not more than 90%.

Here, the tensile strength and the yield ratio may be measured by conducting a tensile test in accordance with ASTM A370. The yield ratio is a ratio of the yield strength to the tensile strength. In the tensile test, full-thickness tensile test pieces having a tensile direction in the C direction (direction perpendicular to the rolling direction) and full-thickness tensile test pieces having a tensile direction in the L direction (direction parallel to the rolling direction) are taken.

(2) Percent ductile fracture ($SA_{-55° C.}$) of 85% or more, as determined by a DWTT test at −55° C., separation index ($SI_{-55° C.}$) of 0.10 $mm^{-1}$ or more: Line pipes, which are used to transport, for example, natural gas, are desired to have a high percent ductile fracture value, as determined by a DWTT test, in order to prevent brittle crack propagation. In an embodiment of the present invention, the percent ductile fracture (SA value), as determined by a DWTT test at −55° C., is 85% or more. Further, the separation index ($SI_{-55° C.}$) is 0.10 $mm^{-1}$ or more. Here, the percent ductile fracture ($SA_{-55° C.}$), as determined by a DWTT test at −55° C., is determined as follows. Press-notched full-thickness DWTT test pieces are taken in accordance with API-5L3 and subjected to an impact bending load by drop weight at −55° C. The longitudinal direction of the test piece is the C direction. The percent ductile fracture is determined from an evaluation region, which is a region excluding a first portion and a second portion in the test piece. The portion (crack initiation region) has a dimension extending from the press notch side to the evaluation region and the second portion (compressive strain region) has a dimension extending from the drop weight impact side to the evaluation region. The dimension of the first portion and the dimension of the second portion are each equal to the thickness, t, of the test piece (in the case that the thickness t<19 mm) or are each 19 mm (in the case that the thickness t≥19 mm). Also, the separation index ($SI_{-55° C.}$) is calculated as follows. Within an evaluation region comparable to the evaluation region for the above-described percent ductile fracture measurement after DWTT testing, separations that occur in the fractured surface of the test piece are visually observed. The lengths of all separations having a length of 1 mm or more are measured and the total sum of the lengths is divided by the area of the evaluation region. The evaluation region is a region excluding a first portion and a second portion in the test piece. The first portion (crack initiation region) has a dimension extending from the press notch side to the evaluation region and the second portion (compressive strain region) has a dimension extending from the drop weight impact side to the evaluation region. The dimension of the first portion, and the dimension of the second portion are each equal to the thickness, t, of the test piece (in the case that the thickness t<19 mm) or are each 19 mm (in the case that the thickness t≥19 mm).

(3) Charpy impact absorbed energy at −55° C. of 160 J or more (preferred condition): It is known that propagating shear fracture (unstable ductile fracture) can occur in high-pressure gas line pipes. In propagating shear fracture, ductile cracks due to an external cause propagate in the pipe axis direction at a speed of 100 m/s or higher, and this can result in catastrophic fracture over several kilometers. An effective way to prevent such propagating shear fracture is to increase absorbed energy. Thus, in the present invention, it is preferable that the Charpy impact absorbed energy at −55° C. not be less than 160 J. Here, the Charpy impact absorbed energy at −55° C. can be measured by conducting a Charpy impact test in accordance with ASTM A370 at −55° C.

(4) Vickers hardness at position 1 mm from surface of steel plate in thickness direction of 260 or less (preferred condition): The temperature of the surface portion of a steel plate is lower than the temperature of a central portion of the steel plate. Thus, when rolling is performed in the two-phase temperature region, the surface portion and the central portion may be different from each other in the microstructure constitution and properties. Also, in the surface portion of the steel plate, where the post-rolling cooling rate is high, hard martensite or martensite-austenite constituent tends to form, and as a result, the hardness of the surface may increase. Such an increase in the hardness of the surface can cause surface defects, such as wrinkles and cracks, and further, can cause brittle crack initiation sites, in the steel pipe forming process, in which stress concentration tends to occur in the surface of the steel plate. For this reason, it is preferable to properly control the hardness of the surface-layer portion. In an embodiment of the present invention, the Vickers hardness at a position 1 mm from the surface of the steel plate in the thickness direction is not more than 260. Here, the Vickers hardness is determined as follows. Test pieces for hardness measurement are taken from the steel plate, and the L cross section (cross section parallel to the rolling direction and perpendicular to the plate surface) is mechanically polished. At a position 1 mm from the surface of the steel plate in the thickness direction, the Vickers hardness is measured at 10 points, for each of the test pieces, in accordance with JIS Z 2244 under a measurement load of 10 kgf, and the average is determined.

Next, the method of the present invention for producing the steel plate for high-strength and high-toughness steel pipes will be described.

The steel plate for high-strength and high-toughness steel pipes, of the present invention, is preferably obtained by a production method including a hot rolling process and a cooling process. In the hot rolling process, a steel slab having the chemical composition described above is heated to a range of 1000° C. or higher and 1250° C. or lower and rolled in the austenite recrystallization temperature range. Thereafter, rolling is performed in a range of the $Ar_3$ temperature or higher and ($Ar_3$ temperature+150° C.) or lower, at an accumulated rolling reduction ratio of 50% or more, and subsequently, rolled in a range of ($Ar_3$ temperature−50° C.) or higher and lower than the $Ar_3$ temperature, at an accumulated rolling reduction ratio of more than 50%. In the cooling process, immediately after the hot rolling process, the plate is cooled by accelerated cooling at a cooling rate of 10° C./s or higher and 80° C./s or lower, to a cooling stop temperature of 250° C. or higher and 450° C. or lower. Subsequently, the plate is naturally cooled to a temperature range of 100° C. or lower. In order to further enhance the effect of improving low-temperature toughness through microstructure refining, it is preferable that the accumulated rolling reduction ratio in a temperature range of the $Ar_3$ temperature or higher and ($Ar_3$ temperature+50° C.) or lower, of the accumulated rolling reduction ratio in the temperature range of the $Ar_3$ temperature or higher and ($Ar_3$ temperature+150° C.) or lower, be 20% or more.

In the descriptions below, the temperature of the steel plate is an average temperature in the thickness direction unless otherwise specified. The average temperature of the steel plate in the thickness direction can be determined from the thickness, surface temperature, cooling conditions, and other conditions by simulation calculation or another method. For example, the average temperature of the steel plate in the thickness direction can be determined by calculating the temperature distribution in the thickness direction by using a finite difference method.

Hot Rolling Process

Steel slab heating temperature: 1000° C. or higher and 1250° C. or lower

The steel slab of the present invention may be produced by continuous casting in order to prevent macro segregation of the components or may be produced by ingot casting. After the steel slab is produced, a conventional method in which the steel slab is once cooled to room temperature and then reheated may be used. Instead, an energy-saving process, such as the following, may be used without any problem. In hot charge rolling, the steel slab, uncooled and warm, is charged into a heating furnace and hot-rolled. In hot charge rolling/hot direct rolling, the steel slab, after temperature holding for a short time, is immediately hot-rolled. In another method (warm slab charging), the steel slab, in the hot state, is charged into a heating furnace so that the reheating can be partially omitted.

If the heating temperature is lower than 1000° C., components for carbides, such as Nb and V, may not sufficiently dissolve in the steel slab. As a result, the effect of increasing strength through precipitation strengthening may not be produced. On the other hand, if the heating temperature is higher than 1250° C., initial austenite grains coarsen. As a result, the Charpy impact absorbed energy may be low and the DWTT property ($SA_{-55°\ C.}$) may be low. Thus, the steel slab heating temperature is 1000° C. or higher and 1250° C. or lower, and preferably 1000° C. or higher and 1150° C. or lower.

In an embodiment of the present invention, after the steel slab is heated, first, the steel slab is rolled in the austenite recrystallization temperature range. By performing rolling in the austenite recrystallization temperature range, the microstructure, coarsened during heating of the steel slab, is refined and the grains are uniformly sized. Thus, the final microstructure, obtained after subsequent rolling in various temperature ranges and cooling, which will be described later, is refined. As a result, the DWTT property ($SA_{-55°\ C.}$) and the Charpy impact absorbed energy of the resulting steel plate are improved. The accumulated rolling reduction ratio in the austenite recrystallization temperature range is not particularly limited, but is preferably 30% or more. Within the range of the chemical composition of an embodiment of the steel of the present invention, the lower limit temperature for austenite recrystallization is approximately 930° C.

Accumulated rolling reduction ratio in a range of $Ar_3$ temperature or higher and ($Ar_3$ temperature+150° C.) or lower: 50% or more The temperature range of the $Ar_3$ temperature or higher and ($Ar_3$ temperature+150° C.) or lower corresponds to a lower-temperature region of the austenite non-crystallization temperature range. Performing rolling in the range of the $Ar_3$ temperature or higher and ($Ar_3$ temperature+150° C.) or lower, in the austenite non-recrystallization temperature range, at an accumulated rolling reduction ratio of 50% or more, causes the austenite grains to become elongated and become fine particularly in the thickness direction. Thus, ferrite and bainite, which are the microstructures obtained after the subsequent rolling in the two-phase region and accelerated cooling, are refined, and as a result, the DWTT property ($SA_{-55°\ C.}$) is improved. On the other hand, if the accumulated rolling reduction ratio is less than 50%, the effect of refining grains is not sufficiently produced. This can result in a failure to achieve a good DWTT property ($SA_{-55°\ C.}$). Thus, the accumulated rolling reduction ratio in the range of the $Ar_3$ temperature or higher and ($Ar_3$ temperature+150° C.) or lower, which is in the austenite non-crystallization temperature range, is 50% or more. The upper limit of the accumulated rolling reduction ratio is not particularly limited. However, if the accumulated rolling reduction ratio is more than 90%, the thickness of the steel slab required is very large, which results in a decrease in heating efficiency, for example. Thus, the energy cost may significantly increase. For this reason, it is preferable that the upper limit of the accumulated rolling reduction ratio in the range of the $Ar_3$ temperature or higher and ($Ar_3$ temperature+150° C.) or lower, which is in the austenite non-crystallization temperature range, be 90%.

In the present invention, the $Ar_3$ temperature used is a value calculated by using the following formula, which is based on the contents of the elements in steel materials. The content (mass %) of each of the elements in the steel is shown with the symbol of the element. The symbol of an element that is not included is assigned a value of 0.

$$Ar_3(°\ C.)=910-310C-80Mn-20Cu-15Cr-55Ni-80Mo$$

Accumulated rolling reduction ratio in temperature range of $Ar_3$ temperature or higher and ($Ar_3$ temperature+50° C.) or lower: 20% or more (preferred condition)

The accumulated rolling reduction ratio in the temperature range of the $Ar_3$ temperature or higher and ($Ar_3$ temperature+50° C.) or lower, of the accumulated rolling reduction ratio in the temperature range of the $Ar_3$ temperature or higher and ($Ar_3$ temperature+150° C.) or lower in the austenite non-crystallization temperature range, is 20% or more. As a result, the austenite grains are further refined, and after rolling in the two-phase region and accelerated cooling, the resulting ferrite and bainite, which form the microstructure of the steel, are further refined. Consequently, the DWTT property ($SA_{-55°\ C.}$) is improved. Thus, it is desirable that the accumulated rolling reduction ratio in the temperature range of the $Ar_3$ temperature or higher and ($Ar_3$ temperature+50° C.) or lower be 20% or more.

Accumulated rolling reduction ratio in a range of ($Ar_3$ temperature−50° C.) or higher and lower than $Ar_3$ temperature: 50% or more Hot rolling is performed in the ferrite-austenite two-phase temperature region, lower than the $Ar_3$ temperature. Thus, deformation is introduced into the ferrite, and deformed ferrite is formed. Consequently, high strength is achieved. Also, separations occur in the fractured surface of the test piece in a test for evaluating brittle crack arrestability, such as a DWTT test. Thus, excellent brittle crack arrestability can be achieved. If the rolling temperature is lower than ($Ar_3$ temperature−50° C.), ferrite transformation progresses, which increases the area fraction of ferrite. As a result, a desired strength may not be achieved. Thus, the rolling temperature range in the two-phase temperature region is ($Ar_3$ temperature−50° C.) or higher and lower than the $Ar_3$ temperature.

If the accumulated rolling reduction ratio in the range of ($Ar_3$ temperature−50° C.) or higher and lower than the $Ar_3$ temperature is 50% or less, a desired amount of deformed ferrite, which is defined as having an aspect ratio of 3 or more, may not be obtained. As a result, although separations occur, the amount of occurrence of separations may be insufficient, and consequently, excellent brittle crack arrestability may not be achieved. Accordingly, the accumulated rolling reduction ratio in the range of ($Ar_3$ temperature−50° C.) or higher and lower than the $Ar_3$ temperature is more than 50%, and preferably is 53% or more. On the other hand, the upper limit of the accumulated rolling reduction ratio in the range of ($Ar_3$ temperature−50° C.) or higher and lower than the $Ar_3$ temperature is not particularly limited. However, if the accumulated rolling reduction ratio is more than 80%, the amount of formation of separations becomes saturated, and moreover, embrittlement of ferrite may decrease the toughness of the base steel. Thus, it is preferable that the accumulated rolling reduction ratio in the temperature range be 80% or less. It is more preferable that the accumulated rolling reduction ratio in the range of ($Ar_3$ temperature−50° C.) or higher and lower than the $Ar_3$ temperature be 70% or less.

Rolling finish temperature: ($Ar_3$ temperature−50° C.) or higher and lower than $Ar_3$ temperature (preferred condition)

Rolling at a high accumulated rolling reduction ratio in the range of ($Ar_3$ temperature−50° C.) or higher and lower than the $Ar_3$ temperature results in high strength, and also, results in occurrence of separations in the fractured surface of a test piece in a test for evaluating brittle crack arrestability, such as a DWTT test. Thus, excellent brittle crack arrestability is achieved. When rolling is performed in a low temperature range lower than ($Ar_3$ temperature−50° C.), the area fraction of ferrite increases. As a result, a desired strength may not be achieved. On the other hand, if the rolling is finished at the $Ar_3$ temperature or higher, a desired amount of deformed ferrite may not be obtained. As a result, although separations occur, the amount of occurrence of separations may be insufficient, and consequently, excellent brittle crack arrestability may not be achieved. Thus, it is preferable that the rolling finish temperature be ($Ar_3$ temperature−50° C.) or higher and lower than the $Ar_3$ temperature.

Cooling Process

Cooling start temperature for accelerated cooling: ($Ar_3$ temperature−80° C.) or higher (preferred condition)

In an embodiment of the present invention, immediately after the hot rolling process, accelerated cooling is started. If the cooling start temperature for accelerated cooling is lower than ($Ar_3$ temperature−80° C.), polygonal ferrite forms in the natural cooling process, after hot rolling and before the start of accelerated cooling. As a result, the strength of the base steel may decrease. Thus, it is preferable that the cooling start temperature for accelerated cooling be ($Ar_3$ temperature−80° C.) or higher. On the other hand, the upper limit of the starting temperature for accelerated cooling is not particularly limited provided that the starting temperature is lower than the $Ar_3$ temperature.

Cooling rate for accelerated cooling: 10° C./s or more and 80° C./s or less

Ferrite that forms after completion of rolling is not deformed and is thus harmful from the standpoint of ensuring strength. For this reason, it is preferable that the accelerated cooling be performed immediately after completion of rolling to allow untransformed austenite to transform to bainite, so that formation of ferrite can be suppressed and the strength can be improved without impairing the toughness of the base steel. If the cooling rate for accelerated cooling is less than 10° C./s, excessive ferrite transformation may occur during cooling, which may result in a decrease in the strength of the base steel. Thus, the cooling rate for accelerated cooling is 10° C./s or more, and preferably 20° C./s or more. On the other hand, if the cooling rate is more than 80° C./s, martensitic transformation tends to occur particularly near the surface portion of the steel plate, which results in an increase in hard phases. As a result, the hardness of the surface increases excessively, which may result in surface defects, such as wrinkles and cracks, when forming steel pipes. Furthermore, surface defects can be initiation sites of ductile cracking or brittle cracking, and thus the Charpy impact absorbed energy and the DWTT property ($SA_{-55° C.}$) may decrease. Thus, the cooling rate for accelerated cooling is 80° C./s or less, and preferably 60° C./s or less. The cooling rate is an average cooling rate obtained by dividing the difference between the cooling start temperature and the cooling stop temperature by the duration.

Cooling stop temperature for accelerated cooling: 250° C. or higher and 450° C. or lower To achieve a tensile strength of 625 MPa or more, the cooling stop temperature is 450° C. or lower to transform untransformed austenite in the steel plate to fine bainite and martensite. If the cooling stop temperature is higher than 450° C., the resulting bainite microstructure is coarse and thus sufficiently high strength may not be achieved. On the other hand, if the cooling stop temperature is lower than 250° C., an excessive amount of martensite may form. As a result, although the strength of the base steel increases, the Charpy impact absorbed energy and the DWTT property ($SA_{-55° C.}$) of the base steel may significantly decrease. This tendency is noticeable particularly at or near the surface portion of the steel plate. Also, the hardness tends to increase excessively at the surface portion, where the cooling rate is high. This may result in surface defects, such as wrinkles and cracks, when forming steel pipes. Thus, the cooling stop temperature for accelerated cooling is 250° C. or higher and 450° C. or lower.

Natural cooling to temperature range of 100° C. or lower

The accelerated cooling is followed by natural cooling to a temperature range of 100° C. or lower.

The production method of the present invention may include one or more optional processes in addition to the hot rolling process and the cooling process, described above. For example, a process, such as shape correction, may be included. Such a process may be performed between the hot rolling process and the cooling process and/or after natural cooling. Reheating after the accelerated cooling and after the natural cooling may be unnecessary.

The steel plate of the present invention may be formed into a steel pipe. Examples of methods for forming such a steel pipe include cold forming, which uses, for example, a UOE process or press bending (also referred to as bending press). With such a method, a steel pipe shape can be formed.

The UOE process may be as follows. Lateral edges of a blank steel plate are subjected to groove cutting edge preparation, and thereafter the lateral edges of the steel plate are subjected to edge crimping using a press machine. Subsequently, the steel plate is formed into a U shape and thereafter into an O shape by using a press machine. In this manner, the steel plate is formed into a cylindrical shape with the lateral edges of the steel plate facing each other. Next, the facing lateral edges of the steel plate are brought into abutment with each other and welded together. Such welding is referred to as seam welding. A preferred method for performing seam welding may include two processes, a tack welding process and a final welding process. In the tack welding process, the cylindrically-shaped steel plate is held and the facing lateral edges of the steel plate are brought into abutment with each other and tack-welded together. In the final welding process, the inner and outer surfaces of the seam of the steel plate are subjected to welding using a submerged arc welding method. After seam welding, expansion is performed in order to remove welding residual stress and to improve the roundness of the steel pipe. In the expansion process, the expansion ratio (ratio of the amount of change of the outer diameter between the post-expansion pipe and the pre-expansion pipe to the outer diameter of the pre-expansion pipe) is usually within a range of 0.3% to 1.5%. From the viewpoint of the balance between the roundness improvement effect and the required capacity of the expansion machine, the expansion ratio is preferably within a range of 0.5% to 1.2%. Subsequently, a coating treatment may be performed for the purpose of corrosion protection. In such a coating treatment, the steel pipe after expansion may be heated to a temperature range of, for example, 200 to 300° C. and thereafter, a known resin, for example, may be applied to the outer surface of the steel pipe.

Cold forming using press bending may be as follows. A steel plate is repeatedly subjected to three-point bending and is gradually shaped to form a steel pipe having a substantially circular cross section. Thereafter, seam welding is performed, as in the UOE process described above. In the case of press bending, too, expansion may be performed after seam welding, and a coating may be applied.

Example 1

Examples of the present invention will now be described. The technical scope of the present invention is not limited to the examples described below.

Molten steels each having a chemical composition shown in Table 1 (the balance is Fe and inevitable impurities) were obtained by steelmaking in a converter, and were each cast into a slab having a thickness of 260 mm. The slab was then subjected to hot rolling and accelerated cooling, under the conditions shown in Table 2, and was naturally cooled to a temperature range of 100° C. or lower (room temperature) to produce a steel plate having a thickness of 31.9 mm. After heating, the slab was rolled in the austenite recrystallization temperature range (within the range of 930 to 1080° C.) at an accumulated rolling reduction ratio of 30% or more.

TABLE 1

| Steel | Chemical composition (mass %) | | | | | | | | | | | | | | | | $Ar_3$*1 | |
|---|---|---|---|---|---|---|---|---|---|---|---|---|---|---|---|---|---|---|
| No. | C | Si | Mn | P | S | Al | Nb | Ti | N | Cu | Ni | Cr | Mo | V | B | Others | (° C.) | Remarks |
| A | 0.02 | 0.20 | 1.5 | 0.005 | 0.0006 | 0.03 | 0.030 | 0.015 | 0.004 | 0.15 | 0.20 | 0.35 | 0.10 | 0.05 | | | 757 | Comparative steel |
| B | 0.04 | 0.20 | 1.9 | 0.005 | 0.0005 | 0.03 | 0.035 | 0.009 | 0.005 | | | 0.25 | 0.35 | | | REM: 0.0040 | 714 | Invention steel |
| C | 0.05 | 0.20 | 1.9 | 0.006 | 0.0006 | 0.05 | 0.040 | 0.010 | 0.005 | | | 0.15 | 0.35 | | | Ca: 0.0015 | 712 | Invention steel |
| D | 0.06 | 0.10 | 1.8 | 0.006 | 0.0004 | 0.04 | 0.035 | 0.010 | 0.004 | | | 0.20 | 0.30 | | | | 720 | Invention steel |
| E | 0.06 | 0.10 | 1.8 | 0.007 | 0.0008 | 0.03 | 0.035 | 0.015 | 0.004 | 0.40 | 0.20 | | 0.26 | | | | 708 | Invention steel |
| F | 0.07 | 0.15 | 1.8 | 0.007 | 0.0011 | 0.03 | 0.030 | 0.015 | 0.003 | 0.35 | 0.30 | | 0.30 | | | | 697 | Invention steel |
| G | 0.08 | 0.20 | 1.7 | 0.008 | 0.0014 | 0.05 | 0.030 | 0.015 | 0.005 | 0.25 | 0.25 | | | 0.10 | | | 730 | Invention steel |
| H | 0.06 | 0.20 | 2.1 | 0.008 | 0.0021 | 0.06 | 0.040 | 0.010 | 0.005 | 0.35 | 0.35 | | | | | | 697 | Invention steel |
| I | 0.05 | 0.40 | 2.4 | 0.007 | 0.0023 | 0.05 | 0.050 | 0.020 | 0.003 | | | 0.05 | 0.10 | | | Zr: 0.0100 | 694 | Invention steel |
| J | 0.06 | 0.35 | 2.0 | 0.007 | 0.0019 | 0.05 | 0.040 | 0.025 | 0.004 | 0.35 | 0.30 | | | | 0.0030 | Mg: 0.0020 | 708 | Invention steel |
| K | 0.04 | 0.10 | 1.8 | 0.006 | 0.0022 | 0.03 | 0.060 | 0.020 | 0.002 | | | 0.25 | 0.30 | | | | 726 | Invention steel |
| L | 0.06 | 0.30 | 1.8 | 0.006 | 0.0017 | 0.02 | 0.040 | 0.020 | 0.005 | 0.40 | 0.20 | | | 0.10 | 0.0010 | | 728 | Invention steel |
| M | 0.05 | 0.20 | 2.1 | 0.005 | 0.0023 | 0.03 | 0.090 | 0.020 | 0.002 | 0.15 | 0.25 | 0.15 | 0.25 | | | | 688 | Comparative steel |
| N | 0.09 | 0.20 | 2.5 | 0.005 | 0.0028 | 0.05 | 0.040 | 0.005 | 0.003 | 0.05 | | | | | | | 681 | Comparative steel |
| O | 0.05 | 0.20 | 2.7 | 0.005 | 0.0006 | 0.03 | 0.020 | 0.010 | 0.003 | 0.05 | 0.05 | | | | | | 675 | Comparative steel |
| P | 0.06 | 0.02 | 1.8 | 0.006 | 0.0017 | 0.02 | 0.040 | 0.020 | 0.005 | 0.40 | 0.20 | | | 0.10 | 0.0010 | | 728 | Comparative steel |
| Q | 0.06 | 0.20 | 1.4 | 0.005 | 0.0006 | 0.03 | 0.020 | 0.010 | 0.003 | | | 0.25 | 0.25 | | | | 756 | Comparative steel |
| R | 0.06 | 0.20 | 2.0 | 0.005 | 0.0006 | 0.03 | 0.020 | 0.010 | 0.003 | | | | | | | | 731 | Comparative steel |
| S | 0.05 | 0.20 | 2.1 | 0.005 | 0.0023 | 0.03 | 0.020 | 0.030 | 0.005 | | | 0.25 | 0.30 | | | | 699 | Comparative steel |

TABLE 1-continued

| Steel | Chemical composition (mass %) | | | | | | | | | | | | | | | | $Ar_3$*[1] | |
|---|---|---|---|---|---|---|---|---|---|---|---|---|---|---|---|---|---|---|
| No. | C | Si | Mn | P | S | Al | Nb | Ti | N | Cu | Ni | Cr | Mo | V | B | Others | (° C.) | Remarks |
| T | 0.04 | 0.10 | 1.5 | 0.005 | 0.0023 | 0.03 | 0.005 | 0.020 | 0.005 | | | 0.25 | 0.30 | | | | 750 | Comparative steel |
| U | 0.05 | 0.10 | 1.6 | 0.005 | 0.0023 | 0.03 | 0.020 | 0.001 | 0.005 | | | 0.25 | 0.25 | | | | 743 | Comparative steel |

*[1]$Ar_3$ = 910—310C—80Mn—20Cu—15Cr—55Ni—80Mo (Contents of elements in steel are shown with corresponding symbol of element (mass %))

TABLE 2

| Steel plate No. | Steel No. | $Ar_3$*[1] (° C.) | Slab heating temperature (° C.) | Accumulated rolling reduction ratio in range of $Ar_3$ temperature or higher and ($Ar_3$ temperature + 150° C.) or lower in non-recrystallization temperature range (%) | Accumulated rolling reduction ratio in temperature range of $Ar_3$ temperature or higher and ($Ar_3$ temperature + 50° C.) or lower i (%) | Accumulated rolling reduction ratio in range of ($Ar_3$ temperature − 50° C.) or higher and less than $Ar_3$ temperature in two-phase temperature range (%) |
|---|---|---|---|---|---|---|
| 1 | A | 757 | 1150 | 61 | 0 | 55 |
| 2 | B | 714 | 1150 | 61 | 0 | 55 |
| 3 | C | 712 | 1150 | 61 | 0 | 55 |
| 4 | D | 720 | 1150 | 61 | 0 | 55 |
| 5 | E | 708 | 1150 | 61 | 0 | 55 |
| 6 | F | 697 | 1150 | 61 | 0 | 55 |
| 7 | G | 730 | 1150 | 61 | 0 | 55 |
| 8 | H | 697 | 1150 | 61 | 0 | 55 |
| 9 | I | 694 | 1150 | 61 | 0 | 55 |
| 10 | J | 708 | 1150 | 61 | 0 | 55 |
| 11 | K | 726 | 1150 | 61 | 0 | 55 |
| 12 | L | 728 | 1150 | 61 | 0 | 55 |
| 13 | M | 688 | 1200 | 61 | 0 | 55 |
| 14 | N | 681 | 1200 | 61 | 0 | 55 |
| 15 | O | 675 | 1150 | 61 | 0 | 55 |
| 16 | P | 728 | 1150 | 61 | 0 | 55 |
| 17 | Q | 756 | 1150 | 61 | 0 | 55 |
| 18 | R | 731 | 1150 | 61 | 0 | 55 |
| 19 | S | 699 | 1150 | 61 | 0 | 55 |
| 20 | T | 750 | 1150 | 61 | 0 | 55 |
| 21 | U | 743 | 1150 | 61 | 0 | 55 |

| Steel plate No. | Rolling finish temperature (° C.) | Cooling start temperature (° C.) | Cooling rate (° C./s) | Cooling stop temperature (° C.) | Remarks |
|---|---|---|---|---|---|
| 1 | 720 | 690 | 20 | 350 | Comparative example |
| 2 | 685 | 655 | 20 | 350 | Invention example |
| 3 | 685 | 655 | 20 | 350 | Invention example |
| 4 | 690 | 660 | 20 | 350 | Invention example |
| 5 | 680 | 650 | 20 | 350 | Invention example |
| 6 | 670 | 640 | 20 | 350 | Invention example |
| 7 | 700 | 670 | 20 | 350 | Invention example |
| 8 | 670 | 640 | 20 | 350 | Invention example |
| 9 | 665 | 635 | 20 | 350 | Invention example |
| 10 | 680 | 650 | 20 | 350 | Invention example |
| 11 | 700 | 670 | 20 | 350 | Invention example |
| 12 | 700 | 670 | 20 | 350 | Invention example |
| 13 | 660 | 630 | 20 | 350 | Comparative example |
| 14 | 645 | 615 | 20 | 350 | Comparative example |
| 15 | 645 | 615 | 20 | 350 | Comparative example |
| 16 | 700 | 670 | 20 | 350 | Comparative example |
| 17 | 725 | 695 | 20 | 350 | Comparative example |
| 18 | 700 | 670 | 20 | 350 | Comparative example |
| 19 | 670 | 640 | 20 | 350 | Comparative example |
| 20 | 720 | 690 | 20 | 350 | Comparative example |
| 21 | 710 | 680 | 20 | 350 | Comparative example |

*[1]$Ar_3$ = 910—310C—80Mn—20Cu—15Cr—55Ni—80Mo (Contents of elements in steel are shown with corresponding symbol of element (mass %))

From the steel plates obtained as described above, full-thickness tensile test pieces having a tensile direction in the C direction and full-thickness tensile test pieces having a tensile direction in the L direction were taken in accordance with ASTM A370, and a tensile test was conducted. The tensile strength (TS) was determined by using the C-direction full-thickness test pieces. The yield strength (YS), the tensile strength (TS), and the yield ratio (YR) were determined by using the L-direction full-thickness test pieces.

Also, for a Charpy impact test, 2 mm V-notched Charpy test pieces were taken from a ½ position of the plate thickness. The longitudinal direction of the test pieces was the C direction. In accordance with ASTM A370, a Charpy impact test was conducted at −55° C. to determine the Charpy impact absorbed energy ($vE_{-55°\ C.}$).

Further, in accordance with API-5L3, press-notched full-thickness DWTT test pieces were taken. The longitudinal direction of the test pieces was the C direction. An impact bending load by drop weight was applied to the test pieces at −55° C. The percent ductile fracture ($SA_{-55°\ C.}$) was determined from an evaluation region, which was a region excluding a first portion and a second portion in the test piece. The first portion (crack initiation region) had a dimension extending from the press notch side to the evaluation region and the second portion (compressive strain region) had a dimension extending from the drop weight impact side to the evaluation region. The dimension of the first portion and the dimension of the second portion were each 19 mm (in this case, thickness t 19 mm). Also, the separation index ($SI_{-55°\ C.}$), which is defined by formula (1), was calculated as follows. Within an evaluation region, which was comparable to the evaluation region for the percent ductile fracture measurement, separations that occurred in the fractured surface of the test piece were visually observed. The lengths of all separations having a length of 1 mm or more were measured and the total sum of the lengths was divided by the area of the evaluation region.

$$SI_{-55°\ C.}\ (mm^{-1}) = \Sigma Li/A \quad (1)$$

ΣLi: the total of the lengths (mm) of separations having a length of 1 mm or more existing in an evaluation region (A) of a DWTT test piece A: the area ($mm^2$) of the evaluation region of the DWTT test piece, the evaluation region being a region excluding a first portion and a second portion in the test piece, the first portion having a dimension extending from the press notch side to the evaluation region, the second portion having a dimension extending from the drop weight impact side to the evaluation region, the dimension of the first portion and the dimension of the second portion each being equal to the thickness, t, of the test piece (in the case that the thickness t<19 mm) or each being 19 mm (in the case that the thickness t≥19 mm).

Measurement of the surface-layer portion hardness was performed as follows. Test pieces for hardness measurement were taken from the steel plates, and the L cross section (cross section parallel to the rolling direction and perpendicular to the plate surface) was mechanically polished. At a region 1 mm deep from the surface of the steel plate in the thickness direction (surface-layer portion), the Vickers hardness was measured at 10 points, for each of the test pieces, in accordance with JIS Z 2244 under a load of 10 kgf, and the average was determined.

Further, test pieces for microstructure observation were taken from a region between a ⅜ position and a ⅝ Position of the plate thickness, relative to one surface of the steel plate. By the method described above, the area fraction of ferrite at a ½ position of the plate thickness, the proportion of deformed ferrite in the ferrite, the area fraction of bainite, and the area fraction of the other microstructures were determined. The results obtained are shown in Table 3.

TABLE 3

| Steel | | Steel microstructure | | | | Base steel tensile properties (C direction) | Base steel tensile properties (L direction) | | |
|---|---|---|---|---|---|---|---|---|---|
| plate No. | Steel No. | Ferrite area fraction (%) | Fraction of deformed ferrite in ferrite (%) | Bainite area fraction (%) | Other microstructure*2 (%) | TS (MPa) | YS (MPa) | TS (MPa) | YR (%) |
| 1 | A | 83 | 30 | 17 | — | 589 | 509 | 577 | 88.2 |
| 2 | B | 63 | 98 | 34 | 3(M) | 763 | 583 | 748 | 77.9 |
| 3 | C | 61 | 93 | 37 | 2(M) | 741 | 576 | 726 | 79.3 |
| 4 | D | 66 | 90 | 32 | 2(M) | 726 | 570 | 712 | 80.1 |
| 5 | E | 61 | 86 | 37 | 2(M) | 709 | 563 | 695 | 81.0 |
| 6 | F | 60 | 97 | 37 | 3(M) | 756 | 581 | 741 | 78.4 |
| 7 | G | 66 | 73 | 34 | — | 653 | 539 | 640 | 84.2 |
| 8 | H | 61 | 88 | 37 | 2(M) | 719 | 567 | 705 | 80.4 |
| 9 | I | 63 | 100 | 34 | 3(M) | 770 | 586 | 755 | 77.6 |
| 10 | J | 62 | 78 | 37 | 1(M) | 675 | 549 | 662 | 82.9 |
| 11 | K | 59 | 85 | 39 | 2(M) | 705 | 561 | 691 | 81.2 |
| 12 | L | 63 | 70 | 37 | — | 639 | 532 | 626 | 85.0 |
| 13 | M | 58 | 100 | 22 | 20(M) | 802 | 566 | 786 | 72.0 |
| 14 | N | 60 | 100 | 10 | 30(M) | 850 | 583 | 833 | 70.0 |
| 15 | O | 59 | 100 | 10 | 31(M) | 846 | 584 | 829 | 70.4 |
| 16 | P | 30 | 70 | 70 | — | 612 | 510 | 600 | 85.0 |
| 17 | Q | 63 | 51 | 14 | 23(P) | 607 | 518 | 595 | 87.1 |
| 18 | R | 70 | 50 | 15 | 15(P) | 581 | 503 | 570 | 88.2 |
| 19 | S | 60 | 100 | 36 | 4(M) | 810 | 586 | 794 | 73.8 |
| 20 | T | 82 | 28 | 18 | — | 583 | 500 | 572 | 87.4 |
| 21 | U | 75 | 50 | 25 | — | 612 | 512 | 600 | 85.3 |

TABLE 3-continued

| Steel plate No. | Base steel toughness vE$_{-55°C}$ (J) | DWTT SA$_{-55°C}$ (%) | SI$_{-55°C}$ (mm$^{-1}$) | Base steel hardness Surface-layer portion HV | Remarks |
|---|---|---|---|---|---|
| 1 | 325 | 80 | 0.05 | 198 | Comparative example |
| 2 | 202 | 95 | 0.15 | 257 | Invention example |
| 3 | 197 | 96 | 0.16 | 249 | Invention example |
| 4 | 194 | 97 | 0.16 | 244 | Invention example |
| 5 | 190 | 98 | 0.16 | 239 | Invention example |
| 6 | 200 | 95 | 0.15 | 252 | Invention example |
| 7 | 177 | 100 | 0.18 | 220 | Invention example |
| 8 | 192 | 97 | 0.16 | 242 | Invention example |
| 9 | 204 | 94 | 0.15 | 255 | Invention example |
| 10 | 182 | 100 | 0.17 | 227 | Invention example |
| 11 | 189 | 98 | 0.17 | 237 | Invention example |
| 12 | 174 | 100 | 0.19 | 215 | Invention example |
| 13 | 130 | 75 | 0.17 | 270 | Comparative example |
| 14 | 110 | 70 | 0.17 | 286 | Comparative example |
| 15 | 112 | 75 | 0.16 | 285 | Comparative example |
| 16 | 174 | 100 | 0.19 | 206 | Comparative example |
| 17 | 166 | 100 | 0.17 | 204 | Comparative example |
| 18 | 161 | 100 | 0.19 | 196 | Comparative example |
| 19 | 145 | 75 | 0.13 | 273 | Comparative example |
| 20 | 330 | 80 | 0.05 | 191 | Comparative example |
| 21 | 185 | 85 | 0.17 | 202 | Comparative example |

*[2]P: pearlite, M: martensite or martensite-austenite constituent

In Nos. 2 to 12, which are Invention Examples, each of the base steels had a tensile strength (TS) in the C direction of 625 MPa or more, a yield ratio (YR) in the L direction of 93% or less, a Charpy impact absorbed energy at −55° C. (vE$_{-55°\ C.}$) of 160 J or more, a percent ductile fracture (SA$_{-55°\ C.}$), as determined by a DWTT test at −55° C., of 85% or more, a separation index (SI$_{-55°\ C.}$) of 0.10 mm$^{-1}$ or more, and a Vickers hardness of the surface-layer portion of 260 or less.

In contrast, in No. 1, which is a Comparative Example, the C content was below the range of embodiments of the present invention. Thus, the hardenability significantly decreased and a large amount of ferrite formed during cooling after rolling. As a result, the area fraction of ferrite was more than a predetermined amount, and consequently a desired tensile strength (TS) was not achieved. Moreover, much of the ferrite that formed during cooling after rolling were not deformed ferrite, and thus the SI$_{-55°\ C.}$ value was outside the range of embodiments of the present invention. As a result, a desired DWTT property (SA$_{-55°\ C.}$) was not achieved.

In No. 13, which is a Comparative Example, the Nb content was above the range of embodiments of the present invention, and thus the hardenability excessively increased. As a result, after accelerated cooling, the amount of formed hard martensite increased, and consequently a desired Charpy impact absorbed energy (vE$_{-55°\ C.}$) and a desired DWTT property (SA$_{-55°\ C.}$) were not achieved. Furthermore, near the surface portion of the steel plate, the amount of formed hard martensite increased, and consequently a desired surface-layer portion hardness was not achieved.

In No. 14, which is a Comparative Example, the C content was above the range of embodiments of the present invention. In No. 15, which is a Comparative Example, the Mn content was above the range of embodiments of the present invention. In Nos. 14 and 15, after accelerated cooling, the amount of formed hard martensite increased, and consequently a desired Charpy impact absorbed energy (vE$_{-55°\ C.}$) and a desired DWTT property (SA$_{-55°\ C.}$) were not achieved. Furthermore, because of the high content of C or Mn, the amount of formed hard martensite increased particularly near the surface portion of the steel plate, and consequently a desired surface-layer portion hardness was not achieved.

In No. 16, which is a Comparative Example, the Si content was below the range of embodiments of the present invention, and thus the increase of strength through solid solution strengthening was insufficient. Consequently, a desired tensile strength was not achieved.

In No. 17, which is a Comparative Example, the Mn content was below the range of embodiments of the present invention. Thus, the hardenability significantly decreased and pearlite transformation occurred during cooling, which resulted in a decreased amount of bainite. Consequently, a desired tensile strength was not achieved.

In No. 18, which is a Comparative Example, Cu, Ni, Cr, Mo, V, and B were not included. Thus, the hardenability significantly decreased and pearlite transformation occurred during cooling, which resulted in a decreased amount of bainite. Consequently, a desired tensile strength was not achieved.

In No. 19, which is a Comparative Example, the Ti content was above the range of embodiments of the present invention. Thus, TiN coarsened and acted as initiation sites of ductile cracking and brittle cracking.
Consequently, a desired Charpy impact absorbed energy (vE$_{-55°\ C.}$) and a desired DWTT property (SA$_{-55°\ C.}$) were not achieved.

In No. 20, which is a Comparative Example, the Nb content was below the range of embodiments of the present invention. Thus, the hardenability significantly decreased and a large amount of ferrite formed during cooling after rolling. As a result, the area fraction of ferrite was more than a predetermined amount, and consequently a desired tensile strength (TS) was not achieved. Moreover, much of the ferrite that formed during cooling after rolling were not deformed ferrite, and thus the SI$_{-55°\ C.}$ value was outside the range of embodiments of the present invention. As a result, a desired DWTT property ($SA_{-55° C.}$) was not achieved.

In No. 21, which is a Comparative Example, the Ti content was below the range of embodiments of the present invention, and thus the increase of strength through precipitation strengthening was insufficient. Consequently, a desired tensile strength was not achieved.

Example 2

Molten steels each having a chemical composition of steel C, E, or G, shown in Table 1 (the balance is Fe and inevitable impurities), were obtained by steelmaking in a converter, and were each cast into a slab having a thickness of 260 mm. The slab was then subjected to hot rolling and accelerated cooling, under the conditions shown in Table 4, and was naturally cooled to a temperature range of 100° C. or lower (room temperature) to produce a steel plate having a thickness of 31.9 mm. After heating, the slab was rolled in the austenite recrystallization temperature range (within the range of 930 to 1080° C.) at an accumulated rolling reduction ratio of 30% or more.

TABLE 4

| Steel plate No. | Steel No. | $Ar_3$*1 (° C.) | Slab heating temperature (° C.) | Accumulated rolling reduction ratio in range of $Ar_3$ temperature or higher and ($Ar_3$ temperature + 150° C.) or lower in non-recrystallization temperature range (%) | Accumulated rolling reduction ratio in temperature range of $Ar_3$ temperature or higher and ($Ar_3$ temperature + 50° C.) or lower (%) | Accumulated rolling reduction ratio in range of ($Ar_3$ temperature − 50° C.) or higher and less than $Ar_3$ temperature in two-phase temperature range (%) |
|---|---|---|---|---|---|---|
| 22 | C | 712 | 1150 | 61 | 0 | 55 |
| 23 | C | 712 | 1150 | 61 | 25 | 55 |
| 24 | C | 712 | 1150 | 61 | 0 | 30 |
| 25 | C | 712 | 1150 | 61 | 0 | 55 |
| 26 | C | 712 | 1150 | 61 | 0 | 55 |
| 27 | C | 712 | 1150 | 75 | 0 | 35 |
| 28 | C | 712 | 1150 | 45.5 | 0 | 55 |
| 29 | C | 712 | 1300 | 61 | 0 | 55 |
| 30 | E | 708 | 1150 | 61 | 0 | 55 |
| 31 | E | 708 | 1100 | 61 | 25 | 55 |
| 32 | G | 730 | 1150 | 61 | 0 | 55 |
| 33 | G | 730 | 950 | 61 | 0 | 55 |
| 34 | G | 730 | 1150 | 61 | 0 | 55 |
| 35 | G | 730 | 1150 | 61 | 0 | 55 |

| Steel plate No. | Rolling finish temperature (° C.) | Cooling start temperature (° C.) | Cooling rate (° C./s) | Cooling stop temperature (° C.) | Remarks |
|---|---|---|---|---|---|
| 22 | 685 | 655 | 20 | 350 | Invention example |
| 23 | 685 | 655 | 20 | 350 | Invention example |
| 24 | 685 | 655 | 20 | 350 | Comparative example |
| 25 | 685 | 655 | 100 | 250 | Comparative example |
| 26 | 685 | 655 | 20 | 150 | Comparative example |
| 27 | 685 | 655 | 20 | 350 | Comparative example |
| 28 | 685 | 655 | 20 | 350 | Comparative example |
| 29 | 685 | 655 | 20 | 350 | Comparative example |
| 30 | 680 | 650 | 20 | 350 | Invention example |
| 31 | 680 | 650 | 20 | 350 | Invention example |
| 32 | 700 | 670 | 20 | 350 | Invention example |
| 33 | 700 | 670 | 20 | 350 | Comparative example |
| 34 | 700 | 670 | 5 | 450 | Comparative example |
| 35 | 700 | 670 | 20 | 500 | Comparative example |

*1 $Ar_3$ = 910—310C—80Mn—20Cu—15Cr—55Ni—80Mo (Contents of elements in steel are shown with corresponding symbol of element (mass %))

The steel plates obtained in the above manner were each subjected to a full-thickness tensile test, a Charpy impact test, and a press-notched full-thickness DWTT test in the same manner as in Example 1 to measure the yield strength (YS), the tensile strength (TS), the Charpy impact absorbed energy ($vE_{-55° C.}$), the percent ductile fracture ($SA_{-55° C.}$), the separation index ($SI_{-55° C.}$), and the surface-layer portion hardness. The results obtained are shown in Table 5.

No. 22 was the same as No. 3 of Example 1, No. 30 was the same as No. 5 of Example 1, and No. 32 was the same as No. 7 of Example 1.

TABLE 5

| Steel | | Steel microstructure | | | | Base steel tensile properties (C direction) | Base steel tensile properties (L direction) | | |
|---|---|---|---|---|---|---|---|---|---|
| plate No. | Steel No. | Ferrite area fraction (%) | Fraction of deformed ferrite in ferrite (%) | Bainite area fraction (%) | Other microstructure*2 (%) | TS (MPa) | YS (MPa) | TS (MPa) | YR (%) |
| 22 | C | 61 | 93 | 37 | 2(M) | 741 | 576 | 726 | 79.3 |
| 23 | C | 60 | 95 | 38 | 2(M) | 740 | 572 | 725 | 78.9 |
| 24 | C | 70 | 45 | 28 | 2(M) | 714 | 555 | 700 | 79.3 |
| 25 | C | 58 | 93 | 10 | 32(M) | 842 | 580 | 825 | 70.3 |
| 26 | C | 60 | 90 | 5 | 35(M) | 852 | 583 | 835 | 69.8 |
| 27 | C | 65 | 40 | 33 | 2(M) | 734 | 570 | 720 | 79.2 |
| 28 | C | 58 | 90 | 40 | 2(M) | 724 | 565 | 710 | 79.6 |
| 29 | C | 56 | 90 | 41 | 3(M) | 714 | 562 | 700 | 80.3 |
| 30 | E | 61 | 86 | 37 | 2(M) | 709 | 563 | 695 | 81.0 |
| 31 | E | 60 | 95 | 38 | 2(M) | 710 | 560 | 696 | 80.5 |
| 32 | G | 66 | 73 | 34 | — | 653 | 539 | 640 | 84.2 |
| 33 | G | 70 | 77 | 30 | — | 620 | 535 | 608 | 88.0 |
| 34 | G | 82 | 45 | 18 | — | 597 | 532 | 585 | 90.9 |
| 35 | G | 65 | 75 | 35 | — | 622 | 530 | 610 | 86.9 |

| | Base steel toughness | | | Base steel hardness | |
|---|---|---|---|---|---|
| Steel plate No. | DWTT $vE_{-55°C}$ (J) | DWTT $SA_{-55°C}$ (%) | DWTT $SI_{-55°C}$ ($mm^{-1}$) | Surface portion HV | Remarks |
| 22 | 197 | 96 | 0.16 | 249 | Invention example |
| 23 | 200 | 100 | 0.16 | 250 | Invention example |
| 24 | 240 | 80 | 0.08 | 240 | Comparative example |
| 25 | 102 | 65 | 0.17 | 305 | Comparative example |
| 26 | 110 | 70 | 0.17 | 285 | Comparative example |
| 27 | 230 | 80 | 0.08 | 245 | Comparative example |
| 28 | 199 | 80 | 0.15 | 238 | Comparative example |
| 29 | 203 | 75 | 0.15 | 233 | Comparative example |
| 30 | 190 | 98 | 0.16 | 239 | Invention example |
| 31 | 195 | 100 | 0.16 | 240 | Invention example |
| 32 | 177 | 100 | 0.18 | 220 | Invention example |
| 33 | 188 | 100 | 0.19 | 207 | Comparative example |
| 34 | 195 | 80 | 0.08 | 198 | Comparative example |
| 35 | 185 | 100 | 0.18 | 207 | Comparative example |

*2P: pearlite, M: martensite or martensite-austenite constituent

In Nos. 22, 23, and 30 to 32, which are Invention Examples, each of the base steels had a tensile strength (TS) in the C direction of 625 MPa or more, a yield ratio (YR) in the L direction of 93% or less, a Charpy impact absorbed energy at −55° C. ($vE_{-55°\ C.}$) of 160 J or more, a percent ductile fracture ($SA_{-55°\ C.}$), as determined by a DWTT test at −55° C., of 85% or more, a separation index ($SI_{-55°\ C.}$) of 0.10 $mm^{-1}$ or more, and a Vickers hardness of the surface-layer portion of 260 or less.

Furthermore, in comparison with No. 22 and No. 30, No. 23 and No. 31 were produced such that the accumulated rolling reduction ratio in the range of ($Ar_3$+150° C.) or less, in the non-recrystallization temperature range, and in addition, the accumulated rolling reduction ratio in a lower temperature range, in the non-recrystallization temperature range, were each set to the preferred range. Thus, austenite was refined before transforming into ferrite and bainite, and consequently, the finally obtained microstructure of the steel plate was refined, which resulted in a higher percent ductile fracture ($SA_{-55°\ C.}$).

In contrast to the above, in No. 24 and No. 27, which are Comparative Examples, the accumulated rolling reduction ratio in the range of ($Ar_3$ temperature−50° C.) or higher and lower than the $Ar_3$ temperature was below the range of embodiments of the present invention, which resulted in a failure to obtain a predetermined amount of deformed ferrite. Consequently, the $SI_{-55°\ C.}$ value was outside the range of embodiments of the present invention. Thus, a desired DWTT property ($SA_{-55°\ C.}$) was not achieved.

In No. 25, which is a Comparative Example, the cooling rate was above the range of embodiments of the present invention and thus, after accelerated cooling, the amount of formed hard martensite increased, and consequently a desired Charpy impact absorbed energy ($vE_{-55°\ C.}$) and a desired DWTT property ($SA_{-55°\ C.}$) were not achieved. Furthermore, near the surface portion of the steel plate, the amount of formed hard martensite increased, and consequently a desired surface-layer portion hardness was not achieved.

In No. 26, which is a Comparative Example, the cooling stop temperature was below the range of embodiments of the present invention and thus, after accelerated cooling, the amount of formed hard martensite increased, and consequently a desired Charpy impact absorbed energy ($vE_{-55°\ C.}$) and a desired DWTT property ($SA_{-55°\ C.}$) were not achieved. Furthermore, near the surface portion of the steel plate, the amount of formed hard martensite increased, and consequently a desired surface-layer portion hardness was not achieved.

In No. 28, which is a Comparative Example, the accumulated rolling reduction ratio in the range of the $Ar_3$ temperature or higher and ($Ar_3$ temperature+150° C.) or lower, in the non-recrystallization temperature range, was below the range of embodiments of the present invention. Thus, the grain refining effect of the microstructure of the steel plate, which resulted from refining of austenite before transforming into ferrite and bainite, was insufficient. Consequently, a desired DWTT property ($SA_{-55°\ C.}$) was not achieved.

In No. 29, which is a Comparative Example, the slab heating temperature was above the range of embodiments of the present invention, and thus, initial austenite grains coarsened, and the grain refining effect of the microstructure of the steel plate was insufficient. Consequently, a desired DWTT property ($SA_{-55°\ C.}$) was not achieved.

In No. 33, which is a Comparative Example, the slab heating temperature was below the range of embodiments of the present invention. Thus, components for carbides, such as Nb and V, did not sufficiently dissolve in the steel slab, and the effect of increasing strength through precipitation strengthening was insufficient. Consequently, a desired tensile strength was not achieved.

In No. 34, which is a Comparative Example, the cooling rate was below the range of embodiments of the present invention. Thus, an excessive amount of ferrite formed during cooling. As a result, a desired tensile strength was not achieved. Furthermore, a predetermined amount of deformed ferrite was not obtained and the $SI_{-55°\ C.}$ value was outside the range of embodiments of the present invention. Consequently, a desired DWTT property ($SA_{-55°\ C.}$) was not achieved.

In No. 35, which is a Comparative Example, the cooling stop temperature was above the range of embodiments of the present invention, and thus, coarse bainite formed. As a result, desired tensile properties were not achieved.

INDUSTRIAL APPLICABILITY

The steel plate for high-strength and high-toughness steel pipes, of the present invention, can be used for line pipes, which are used to transport natural gas or crude oil, for example. Thus, the steel plate can greatly contribute to improvement in transport efficiency, which is achieved by higher-pressure operation, and to improvement in on-site welding efficiency, which is achieved by the thin wall.

The invention claimed is:

1. A steel plate for high-strength and high-toughness steel pipes, the steel plate having a chemical composition containing, by mass %, C: 0.03% or more and 0.08% or less,
Si: more than 0.05% and 0.50% or less,
Mn: 1.5% or more and 2.5% or less,
P: 0.001% or more and 0.010% or less,
S: 0.0030% or less,
Al: 0.01% or more and 0.08% or less,
Nb: 0.010% or more and 0.080% or less,
Ti: 0.005% or more and 0.025% or less, and
N: 0.001% or more and 0.006% or less, and further containing, by mass %, at least one selected from
Cu: 0.01% or more and 1.00% or less,
Ni: 0.01% or more and 1.00% or less,
Cr: 0.01% or more and 1.00% or less,
Mo: 0.01% or more and 1.00% or less,
V: 0.01% or more and 0.10% or less, and
B: 0.0005% or more and 0.0030% or less, with the balance being Fe and inevitable impurities, wherein the steel plate has a microstructure in which an area fraction of ferrite at a ½ position of a thickness of the steel plate is 20% or more and 80% or less and deformed ferrite constitutes 50% or more and 100% or less of the ferrite, wherein separations that occur in a fractured surface of a test piece of the steel plate have a separation index ($SI_{-55°\ C.}$) of 0.10 $mm^{-1}$ or more provided that the test piece is subjected to a DWTT test (Drop Weight Tear Test) at a test temperature of −55° C., the separation index being defined by formula (1):

$$SI_{-55°\ C.}\ (mm^{-1})=\Sigma Li/A \quad (1)$$

where ΣLi: a total of lengths (mm) of separations having a length of 1 mm or more existing in an evaluation region (A) of the test piece for the DWTT test, A: an area ($mm^2$) of the evaluation region of the test piece for the DWTT test, the evaluation region being a region excluding a first portion and a second portion in the test piece, the first portion having a dimension extending from a press notch side to the evaluation region, the second portion having a dimension extending from a drop weight impact side to the evaluation region, the dimension of the first portion and the dimension of the second portion each being equal to a thickness, t, of the test piece (in a case that the thickness t<19 mm) or each being 19 mm (in a case that the thickness t≥19 mm), wherein the steel plate has a tensile strength of 625 MPa or more, and a Charpy impact absorbed energy at −55° C. ($vE_{-55°C.}$) of 160 J or more, wherein the steel plate has a percent ductile fracture of 85% or more, as determined by a DWTT test at −55° C.

2. The steel plate according to claim 1 for high-strength and high-toughness steel pipes, wherein the chemical composition further contains, by mass %, at least one selected from Ca: 0.0005% or more and 0.0100% or less, REM: 0.0005% or more and 0.0200% or less, Zr: 0.0005% or more and 0.0300% or less, and Mg: 0.0005% or more and 0.0100% or less.

3. A method for producing a steel plate for high-strength and high-toughness steel pipes, the method being formulated to produce the steel plate according to claim 1 for high-strength and high-toughness steel pipes, the method comprising:

hot rolling, the hot rolling being carried out by heating a steel slab to a range of 1000° C. or higher and 1250° C. or lower, rolling the steel slab in an austenite recrystallization temperature range, thereafter rolling is performed in a range of an $Ar_3$ temperature or higher and ($Ar_3$ temperature+150° C.) or lower, at an accumulated rolling reduction ratio of 50% or more, and thereafter rolling is performed in a range of (the $Ar_3$ temperature−50° C.) or higher and lower than the $Ar_3$ temperature, at an accumulated rolling reduction ratio of more than 50%; and cooling, the cooling being carried out, immediately after the hot rolling, by cooling the steel plate by accelerated cooling at a cooling rate of 10° C./s or higher and 80° C./s or lower to a cooling stop temperature of 250° C. or higher and 450° C. or lower, and thereafter naturally cooling the steel plate to a temperature range of 100° C. or lower.

4. A method for producing a steel plate for high-strength and high-toughness steel pipes, the method being formulated to produce the steel plate according to claim 2 for high-strength and high-toughness steel pipes, the method comprising:

hot rolling, the hot rolling being carried out by heating a steel slab to a range of 1000° C. or higher and 1250° C. or lower, rolling the steel slab in an austenite recrystallization temperature range, thereafter rolling is performed in a range of an $Ar_3$ temperature or higher and ($Ar_3$ temperature+150° C.) or lower, at an accumulated rolling reduction ratio of 50% or more, and thereafter rolling is performed in a range of (the $Ar_3$ temperature−50° C.) or higher and lower than the $Ar_3$ temperature, at an accumulated rolling reduction ratio of more than 50%; and cooling, the cooling being carried out, immediately after the hot rolling, by cooling the steel plate by accelerated cooling at a cooling rate of 10° C./s or higher and 80° C./s or lower to a cooling stop temperature of 250° C. or higher and 450° C. or lower, and thereafter naturally cooling the steel plate to a temperature range of 100° C. or lower.

5. The steel plate according to claim 1 for high-strength and high-toughness steel pipes, wherein the deformed ferrite is a ferrite having an aspect ratio of 3 or more, the aspect ratio being a ratio of the ferrite grain length in the rolling direction to the ferrite grain length in the thickness direction.

6. The steel plate according to claim 2 for high-strength and high-toughness steel pipes, wherein the deformed ferrite is a ferrite having an aspect ratio of 3 or more, the aspect ratio being a ratio of the ferrite grain length in the rolling direction to the ferrite grain length in the thickness direction.

7. The method according to claim 3 for high-strength and high-toughness steel pipes, wherein the deformed ferrite is a ferrite having an aspect ratio of 3 or more, the aspect ratio being a ratio of the ferrite grain length in the rolling direction to the ferrite grain length in the thickness direction.

8. The method according to claim 4 for high-strength and high-toughness steel pipes, wherein the deformed ferrite is a ferrite having an aspect ratio of 3 or more, the aspect ratio being a ratio of the ferrite grain length in the rolling direction to the ferrite grain length in the thickness direction.

9. The steel plate according to claim 1 for high-strength and high-toughness steel pipes, wherein the steel plate has the microstructure in which an area fraction of bainite at the ½ position of the thickness of the steel plate is 20% or more and 80% or less and a total area fraction of the microstructure, other than ferrite, deformed ferrite and bainite, is 10% or less.

10. The steel plate according to claim 2 for high-strength and high-toughness steel pipes, wherein the steel plate has the microstructure in which an area fraction of bainite at the ½ position of the thickness of the steel plate is 20% or more and 80% or less and a total area fraction of the microstructure, other than ferrite, deformed ferrite and bainite, is 10% or less.

11. The method according to claim 3 for high-strength and high-toughness steel pipes, wherein the steel plate has the microstructure in which an area fraction of bainite at the ½ position of the thickness of the steel plate is 20% or more and 80% or less and a total area fraction of the microstructure, other than ferrite, deformed ferrite and bainite, is 10% or less.

12. The method according to claim 4 for high-strength and high-toughness steel pipes, wherein the steel plate has the microstructure in which an area fraction of bainite at the ½ position of the thickness of the steel plate is 20% or more and 80% or less and a total area fraction of the microstructure, other than ferrite, deformed ferrite and bainite, is 10% or less.

13. The steel plate according to claim 5 for high-strength and high-toughness steel pipes, wherein the steel plate has the microstructure in which an area fraction of bainite at the ½ position of the thickness of the steel plate is 20% or more and 80% or less and a total area fraction of the microstructure, other than ferrite, deformed ferrite and bainite, is 10% or less.

14. The steel plate according to claim 6 for high-strength and high-toughness steel pipes, wherein the steel plate has the microstructure in which an area fraction of bainite at the ½ position of the thickness of the steel plate is 20% or more and 80% or less and a total area fraction of the microstructure, other than ferrite, deformed ferrite and bainite, is 10% or less.

15. The method according to claim 7 for high-strength and high-toughness steel pipes, wherein the steel plate has the microstructure in which an area fraction of bainite at the ½ position of the thickness of the steel plate is 20% or more and 80% or less and a total area fraction of the microstructure, other than ferrite, deformed ferrite and bainite, is 10% or less.

16. The method according to claim 8 for high-strength and high-toughness steel pipes, wherein the steel plate has the microstructure in which an area fraction of bainite at the ½ position of the thickness of the steel plate is 20% or more and 80% or less and a total area fraction of the microstructure, other than ferrite, deformed ferrite and bainite, is 10% or less.

* * * * *